United States Patent [19]

Schwartz et al.

[11] 4,305,362

[45] Dec. 15, 1981

[54] CENTRIFUGAL RPM GOVERNOR FOR FUEL INJECTED INTERNAL COMBUSTION ENGINES

[75] Inventors: Reinhard Schwartz; Ernst Ritter; Rolf Müller; Werner Brühmann, all of Stuttgart, Fed. Rep. of Germany

[73] Assignee: Robert Bosch GmbH, Stuttgart, Fed. Rep. of Germany

[21] Appl. No.: 56,743

[22] Filed: Jul. 11, 1979

[30] Foreign Application Priority Data

Jul. 9, 1978 [DE] Fed. Rep. of Germany ..... 2838919

[51] Int. Cl.[3] ..... F02D 1/04

[52] U.S. Cl. ..... 123/372; 123/367; 123/364

[58] Field of Search ..... 123/367, 364, 365, 372, 123/373, 374

[56] References Cited

U.S. PATENT DOCUMENTS 2,764,965 10/1956 Tuscher ..... 123/364

3,620,199 11/1971 Kuhn ..... 123/374

3,903,860 9/1975 Maier ..... 123/374

*Primary Examiner*—Charles J. Myhre

*Assistant Examiner*—Carl Stuart Miller

*Attorney, Agent, or Firm*—Edwin E. Greigg

[57] ABSTRACT

A centrigural rpm governor for fuel injected internal combustion engines is proposed in which an adaptor assembly located inside the governor can be used over the entire range of practical applications of such a governor. The governor includes parallel coextensive arms, a governor lever and a cooperative governor rod which has a counterstop provided with a sliding block that is movably disposed between the parallel coextensive arms against the initial stressing force of a spring member with the counterstop being arranged to cooperate with a stop means pivotally associated with the housing. The spring member is arranged to load the sliding block and adjustable for the purpose of varying the initial stress and setting the onset of adjustment.

7 Claims, 4 Drawing Figures

CENTRIFUGAL RPM GOVERNOR FOR FUEL INJECTED INTERNAL COMBUSTION ENGINES

CROSS-REFERENCE TO RELATED PRIOR ART

There are no patents or printed publications having a bearing on the patentability of the present invention, but of interest is the following:

German Auglegeschrift No. 2334729

The above reference, whether taken and viewed singly or in combination with other art, is believed not to have a bearing on the patentability of any claim of this invention.

BRIEF SUMMARY OF THE INVENTION

The present invention relates to an improved centrifugal rpm governor for fuel injected internal combustion engines having an adaptor located inside the governor housing and used over an entire range of applications.

BACKGROUND OF THE INVENTION

The invention relates to improvements in a centrifugal rpm governor as disclosed herein and finally claimed. Such a centrifugal rpm governor is already known from the German Auslegeschrift 23 34 729, which discloses an "internal adjustment device" including, as its most important structural part, a counterstop disposed upon the connecting element between the governor lever and the governor rod in the injection pump, the position of the counterstop being adjusted by the force of an adjustment spring. This counterstop comprises a trip lever, which pivots to perform the adjustment control movement. The adjustment spring is stretched between one end of this trip lever and an adjustable support; such spring is provided with a relatively high degree of stiffness in order to obviate spring buckling which might otherwise occur, due to the oblique relationship between contact surfaces at least in one operational position. Because of such embodiment, the useful range of the adjustment device is severely restricted; that is, a stiff adjustment spring can function only during large differential rpm levels between the onset and the cessation of the adjustment control movement. Furthermore, the effective spring tension varies over the path of the adjustment control movement as a result of the variable action of the lever arm on the counterstop.

OBJECT AND SUMMARY OF THE INVENTION

The centrifugal rpm governor in accordance with the invention has the advantage over the prior art that even soft adaptation springs provided with high initial stressing forces can be used in the adaptor assembly in every operational position because of the effective guidance of the adjustment spring and because of the situation of both its supports in parallel planes. Also, because very stiff spring members can be installed and the adjustment control stroke undergoes a structural limitation, all adjustment control paths which occur in practice are possible, with the onset of operation and cessation thereof being variable within wide limits. The support which is adjustable in the direction of the longitudinal axis of the connecting element and is secured by a clamping means enables, in a much simpler manner, a variation of the initial stressing of the spring and thus of the onset of adjustment, and as a result of the displacement of the sliding block toward the spring member while preventing an inordinate degree of stress the force of the spring member is unchanged and remains equally effective over the entire path of adjustment. During adjustment of the position of the set screw, the force engagement position remains the same.

As recited in the dependent claims, further advantageous embodiments and improvements of the centrifugal rpm governor revealed herein are possible. The recitation of the structural features revealed in claims 2, 3 and 4 produce an inexpensive and space-saving structure. As a result of the keying elements which are struck out of the surface of the parallel arms, and which act as protuberances to engage the longitudinal grooves of the sliding block, a friction-free, non-tilting guidance of the sliding block is attainable, and as a result of the disclosure of claim 5 even errors in positioning of the keying elements or the longitudinal grooves disposed in the sliding block do not affect the operation. A secure and simply adjustable, displaceable support for the spring member is attained by means of the recitations in claim 6, and an automatic positional securing of the threaded casing is attained with the structure recited in claim 7.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
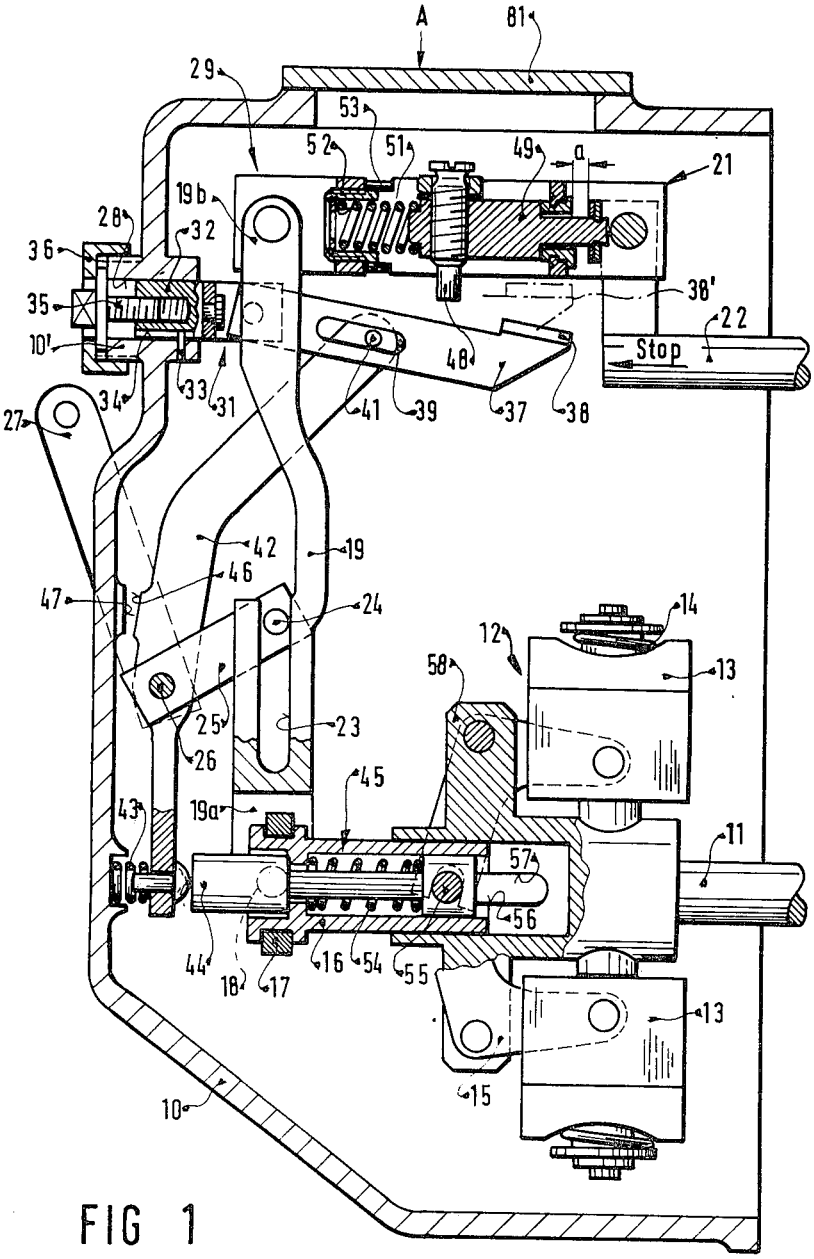
FIG. 1 is a longitudinal cross sectional view through a centrifugal rpm governor embodied in accordance with the invention.

Turning now to the drawings, the centrifugal rpm governor shown in FIG. 1 has a flyweight governor 12 secured within a housing 10 on the drive shaft 11 of an injection pump for internal combustion engines which is known per se and not shown in further detail. The flyweights 13 of this flyweight governor 12, in a known manner, transmit their control movements, under the effect of centrifugal force against the force of governor springs 14, into a governor sleeve 16 which acts as the governor member. An intermediate lever 19 is coupled with the governor sleeve 16 via a slide ring 17 and its bearing member 18. The intermediate lever 19 is embodied as a two-armed element with its first lever arm **19*a* pivotally connected with the governor sleeve 16 and its other lever arm 19*b* also pivotally connected via a pair of parallel coextensive arms indicated at 21 which acts as the connecting element for a governor rod 22** of the injection pump.

The intermediate lever 19 has an integrated slotted guideway 23, into which a pin means 24 of a steering lever 25 is arranged to extend. This steering lever 25 in turn is rotationally connected via a pivoting means 26 with an adjustment lever 27.

The governor housing 10 is provided with a trunnion-like means 10' that includes a through extending bore 28, the axis of which extends in the same direction as the axis of the governor rod 22 and in which a stop means 31, which is associated with an adaptor assembly 29, is supported. A cylindrical element 32 also associated with the stop means 31 is supported in the bore 28 and secured against twisting by means of a pin 33, which slidably engages a groove 34. The element 32 is longitudinally adjustable in the bore by means of an adjusting screw 35, which is held in its installed position by a lock nut 36.

The stop means 31, together with the other structural elements which provide for adjustment and support capacity, may naturally also be located in a separate housing inserted into the governor housing 10.

There is pivotally secured on the cylindrical element 32 of the stop means 31 a stop bracket 37, which projects into the governor housing 10 and this bracket further includes a stop means 38 on its outermost end which is bent at a right angle to the plane thereof. The stop bracket 37 is held in its position shown in FIG. 1, which enables a movement of the governor rod 22 into its starting position, by a pin 41 of a control lever 42 which engages an elongated slot 39 provided on the bracket 37.

The control lever 42 is part of a known starting apparatus and is pivotably supported on the pivot means 26 and there held, in the rest position of the governor parts against the force of a spring means 43 by a deflection bolt 44 of an accumulator 45, in the illustrated starting position until, with the engine in operation, the flyweights 13 move the deflection bolt 44 to the right (as viewed in the drawing) and the control lever 42 that is provided with a stop surface 46 comes into contact with a stop 47 formed integrally with the housing. The stop bracket 37 is thereby lifted by the pin 41 and its stop means 38 is displaced into its full-load position 38' shown in dot-dash lines. (This position of the stop bracket 37 is described below in connection with FIG. 4 and is also further illustrated there.)

The parallel coextensive arms 21 have, as a further element formed as a part of the adaptor assembly 29, a counterstop 48 which, in the form of a setting screw, is secured in a sliding block 49, which is displaceably guided in the parallel coextensive arms 21 in the longitudinal direction thereof and thus parallel to the longitudinal axis of the governor rod 22 against the force of a spring member 51. The spring member 51 is stretched between the sliding block 49 and a threaded casing 52 which acts as an adjustable support, which is held in its set position and accordingly secured against self-actuated twisting, by a holding means 53 embodied as a ratchet mechanism. Other structural details of the parallel coextensive arms 21 are described further below in connection with FIGS. 2 and 3.

In the centrifugal rpm governor in accordance with the invention, which functions as an adjustment rpm governor, the accumulator 45 housed in the governor sleeve 16 and comprising the deflection bolt 44 and a spring 54 serves as a drag member, and its spring 54 is mutually adapted to the spring 51 of the adaptor assembly 29 for the purpose of controlling the adjustment. The deflection bolt 44 is connected via a transversely extending pin 55 with the bell cranks 15, and the distance between this pin 55 and the bearing member 18 remains identical so long as no force exceeding the initial stressing force of the spring 54 is exerted on the governor sleeve 16. If, for example, the adjustment lever 27 and thus the pin element 24 as well are rotated clockwise in order to attain a larger fuel supply quantity or to control a higher rpm level, and if the intermediate lever 19 thereupon tends to move outward beyond the position defined by the stop means 38 of the stop 31, then the spring 54 is compressed and prestressed in a known manner. The relative motion between the transversely extending pin 55 and the governor sleeve 16 is made possible by longitudinal slits 57 that are provided in a coupler part 58 of the flyweight governor 12.

Figure 2:
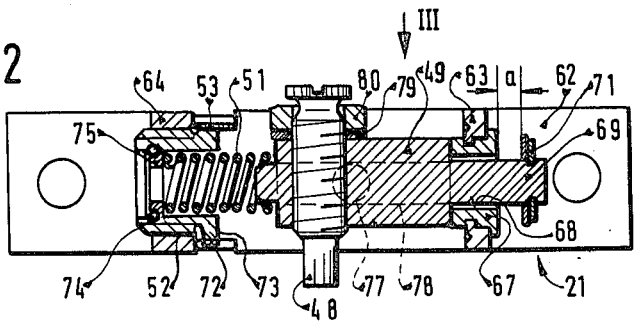
FIGS. 2 and 3 are a side view and plan view, respectively, of the connecting part provided with the structural elements essential to the invention between the governor lever and the governor rod of the injection pump, in enlarged scale.
Figure 3:
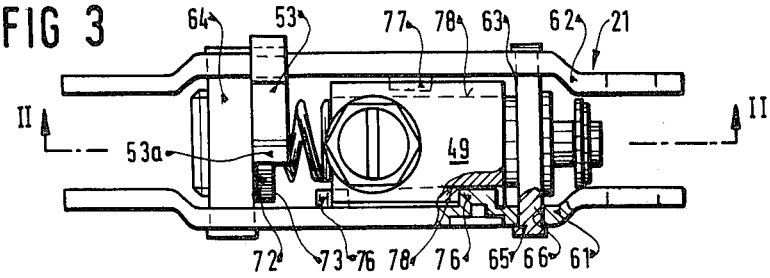

The parallel coextensive arms 21 shown in enlarged scale in FIGS. 2 and 3 are shown in FIG. 2 as a longitudinal section along the line II—II in FIG. 3 and in FIG. 3 as a plan view in the direction of the arrow III of FIG. 2. The parallel arms 21 comprise two elongated generally flat elements 61 and 62 that are disposed in parallel relation to one another, and these elements are connected by two transversely extending strip members 63 and 64. In addition, the transverse strip members 63 and 64 are provided on their opposite ends with protuberances 65 which extend through holes 66 that are punched in the parallel arms 61 and 62 with the protuberances being upset to form rivets on the outside of the arms.

In the first transverse strip 63, a sleeve 67 which functions as a stop means is suitably secured by annular caulking as shown, and projecting through the bore 68 of the sleeve is a shank 69 of the sliding block 49 which is provided with an end stop 71 for limiting the stroke "a" of the sliding block 49. This end stop 71 comprises a snap ring and an equalizer disc, the thickness of which can be varied in a known manner in order to vary the dimension "a".

A threaded casing 52 which acts as the adjustable support for the spring member 51 is threaded into the aperture of the second transverse strip 64, said casing further including a shoulder 73 provided with a circular series of serrations 72 indicated as engaged by a stop spring 53 which serves as a holder means and which is embodied by a spring clip and secured in a form-locking manner on the parallel arm 62. The stop spring 53 is secured on the parallel arm 62 in the manner of a spring clamp and on its free lever end has a detent 53*a* bent in the form of a V which at any given time engages one tooth of the serration 72 and thus secures the rotary position of the threaded casing 52 in the manner of a ratchet gear. The spring member 51 is supported in the interior of the threaded casing 52 on a support ring 75 held by a securing ring 74.

The guidance of the sliding block 49 is achieved by inwardly extending keying means 76 and 77 that are disposed one each on the inwardly extending walls of the parallel arms 61 and 62. The keying means act as guidance elements, which engage longitudinally extending grooves 78 provided in oppositely extending areas of the sliding block 49. The protuberances 76 and 77 consist of keying elements 76, 77 that are formed by upsetting the metal from which the parallel arms 61, 62 are constructed. As shown the one arm 61 is provided with two keying means 76, 76 and the other parallel arm 62 is provided with one key 77, so that any small shifts in position which may arise during assembly of the parallel arms 61 and 62 cannot affect the quality of the guideway provided by this assembly. The guidance is thus furnished by a so-called three-point bearing.

The counterstop 48 is embodied as a set screw and is threaded through the sliding block 49 and held in its inserted position by means of a locking washer 79 and a nut 80. The set screw 48 is constructed as a cap screw to prevent it from falling into the governor as might happen by mistake in the event of its being inserted too far into the parallel arms.

An adjustment both of the counterstop 48 and of the threaded casing 52 acting as a support can be made from outside the governor after removal of a cover 81 (see FIG. 1). The stroke "a" of the sliding block 49 which determines the adjustment control path is, as has already been described, preadjusted.

Figure 4:
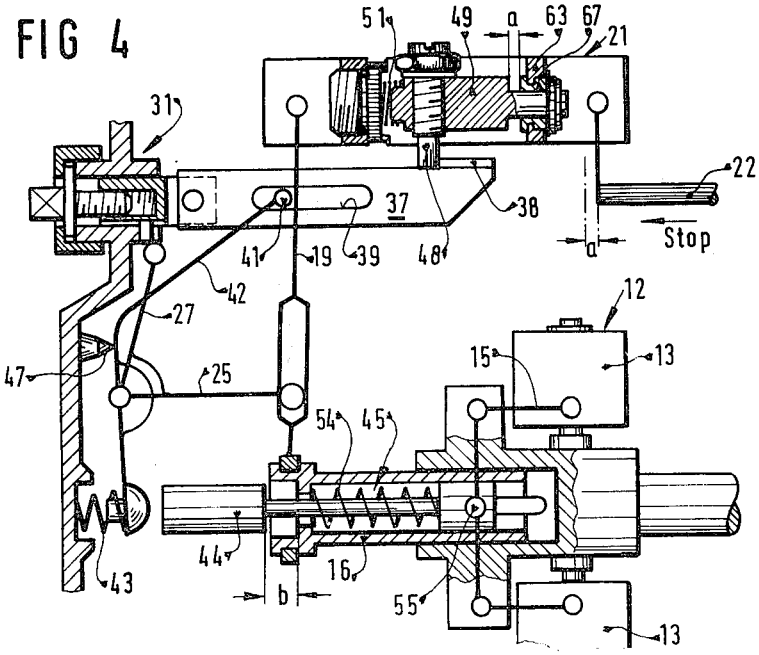
FIG. 4 is a simplified representation of the centrifugal rpm governor with the connecting element shown in the position it has at the onset of adjustment.

FIG. 4 additionally serves to explain the mode of operation and shows the exemplary embodiment of FIG. 1 in simplified form and in a different operational position. While in FIG. 1 all the moving governor parts are shown in the position in which they are located when the governor stops and when the adjustment lever 27 is in the stop position, the adjustment lever 27 of FIG. 4 is in its full-load position or in its operational position which determines the maximum rpm. The other governor parts are shown in the position which they assume at an rpm above the idling rpm before the onset of adjustment. The flyweights 13 have performed their idling stage and have moved the deflection bolt 44, via the bell cranks 15 and the transverse pins 55, so far to the right that it is no longer in contact with the control lever 42. The control lever 42, under the force of the spring 43, is now in contact with its stop 47 and has already pivoted the stop bracket 37 into its full-load position shown in FIG. 4 (indicated at 38' in FIG. 1) by means of the pin 41 engaging the elongated slot 39 of the stop bracket 37. The counterstop 48 therefore is now in contact with the lower extremity of the stop 38 of the stop bracket 37, and the intermediate lever 19 is displaced forward by the adjustment lever 27, which has previously been put into the full-load position, to such an extent that both the spring member 51 in the pair of parallel arms 21 and the deflection spring 54 in the accumulator 45 are prestressed, the spring member 51 being prestressed by the extent of its adjustment control stroke "a" and the spring member 51 by the extent of its deflection stroke "b". The governor rod 22 of the injection pump is thereupon in a full-load position assumed at relatively low rpm. The adjustment control stroke "a" provided by the parallel arms indicated generally as 21 is, in the present invention, identical with the corresponding control path "a" performed at the governor rod 22 upon compensation.

The mode of operation of the centrifugal rpm governor in accordance with the invention will now be described with the aid of FIGS. 1 and 2.

In FIG. 1, the adjustment lever 27 and thus the steering lever 25 and the guide pin 24 as well are in the stop position. Because the rpm are zero, the flyweights of the flyweight governor 12 are also in their inner position and the governor sleeve 16, via the intermediate lever 19 and the parallel arms 21, holds the governor rod 22 in the illustrated stop position. The control lever 42 is pivoted by the deflection bolt 44 against the force of the coil spring 43 into a position in which it has pivoted the stop bracket 27 of the stop 31 out of the way of the counterstop 48 on the parallel arms 21, so that the governor rod 22, with the adjustment lever 27 pivoted into the full-load position for engine starting, can move into a starting position which exceeds the full-load position. At the first run-up of the engine, the flyweights 13 then swing outward and draw the parallel arms 21 and the governor rod 22, via the intermediate lever 19, back out of their starting position. The control lever 42 thence moves into its position shown in FIG. 4 and as the rpm level drops again the counterstop 48 carried by the parallel arms 21 contacts the stop means 38 of the stop bracket 37 and thus limits the full-load position of the governor rod 22 shown in FIG. 4 for lower-level rpm. If the rpm level now continues to rise, then the flyweights 13 move outward and the distance "b" between the head of the deflection bolt 44 and the governor sleeve 16 decreases, until at a balance of the spring forces the spring member 51 disposed in the parallel arms 21 begins to relax. At this rpm level, the so-called adjustment control stroke begins, at which time the governor rod 22 is drawn back, until the end of adjustment, by the dimension "a" in the direction of "stop". This adjustment control movement prevents, in a known manner, smoking of the internal combustion engine at high rpm. If the parallel arms 21 have covered the adjustment control stroke "a", then the sliding block 49 is in contact with the stop sleeve 67 of the transverse strip member 63, as shown in FIG. 1 and in FIGS. 2 and 3. The full-load position thus set is maintained by the governor rod 22 until upon reaching the terminal rpm to be regulated the distance "b" between the deflection bolt 44 and the governor sleeve 16 has decreased to zero and the control rod 22, via the governor sleeve 16 and the intermediate lever 19 as well as the parallel arms 21 have been withdrawn in the direction of its stop position.

As may be seen from FIG. 1, after the cover 81 is removed the counterstop 48 embodied as a set screw and the threaded casing 52 which acts as the adjustable support for the spring member 51 can be adjusted from the outside. The so-called start suppression rpm is set by means of the position of the set screw 48; beyond this rpm, the stop means 38 of the stop bracket 37 prevents a movement of the counterstop 48 in excess of the full-load setting. The onset or cessation is set, with a fixed adjustment control stroke "a", via the variation in prestressing of the adjustment spring member 51. Both setting procedures may be undertaken, if necessary, when the governor is in operation as well.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A centrifugal rpm governor for fuel injected internal combustion engines comprising a governor member arranged to move a governor rod of an injection pump via an intermediate lever and a connecting means, an adaptor assembly arranged to limit the path of the governor rod in the direction of increasing supply quantity to vary the full-load supply quantity in accordance with rpm, said adaptor assembly comprising an adjustable stop supported in a governor housing, a counterstop disposed on the connecting means and movable against the force of a spring member, the spring member being stretched between the counterstop and an adjustable support on the connecting means, said counterstop being provided with a sliding block arranged to be slidably supported upon said connecting means, said spring member providing for longitudinal adjustment of said sliding block, said adjustable support arranged to be adjusted axially of said sliding block and secured by a holding means, said sliding block and said counterstop guided by means mounted on said connecting means, said means for guiding said sliding block and stop counterstop including keying means carried by said connecting means, said keying means arranged to cooperate with longitudinally extending grooves in said sliding block.

2. A centrifugal rpm governor in accordance with claim 1, further wherein said keying means are formed by upsetting the connecting means to provide offstanding protuberances.

3. A centrifugal rpm governor in accordance with claim 2, further wherein a first of said connecting means includes one protuberance and the other of said connecting means includes a pair of protuberances.

4. A centrifugal rpm governor for fuel injected internal combustion engines comprising a governor member arranged to move a governor rod of an injection pump via an intermediate lever and a connecting means, an adaptor assembly arranged to limit the path of the governor rod in the direction of increasing supply quantity to vary the full-load supply quantity in accordance with rpm, said adaptor assembly comprising an adjustable stop supported in a governor housing, a counterstop disposed on the connecting means and movable against the force of a spring member, the spring member being stretched between the counterstop and an adjustable support on the connecting means, said counterstop being provided with a sliding block arranged to be slidably supported upon said connecting means, said spring member providing for longitudinal adjustment of said sliding block, said adjustable support arranged to be adjusted axially of said sliding block and secured by a holding means, said sliding block and said counterstop guided by means mounted on said connecting means, said connecting means including a pair of spacedly arranged transverse strips, one of said strips providing a stroke stop for the sliding block and the other of said transverse strips arranged to receive a threaded casing which forms a support for said spring member.

5. A centrifugal rpm governor in accordance with claim 4, further wherein said threaded casing includes an annular serrated area arranged to cooperate with detent means supported by at least one of said connecting means.

6. A centrifugal rpm governor in accordance with claim 4, further wherein one of said transverse strips includes a bore through which means on said sliding block is arranged to project and said means provided with stop means to limit the stroke of said sliding block.

7. A centrifugal rpm governor in accordance with claim 5, further wherein one of said transverse strips includes a bore through which means on said sliding block is arranged to project and said means provided with stop means to limit the stroke of said sliding block.

* * * * *

UNITED STATES PATENT AND TRADEMARK OFFICE

CERTIFICATE OF CORRECTION

PATENT NO. : 4,305,362
DATED : December 15, 1981
INVENTOR(S) : Reinhard Schwartz et al.

It is certified that error appears in the above-identified patent and that said Letters Patent is hereby corrected as shown below:

On the title page, German Priority Document date should read

-- September 7, 1978 --

Signed and Sealed this

*Twenty-third* Day of *November 1982*

[SEAL]

*Attest:*

GERALD J. MOSSINGHOFF

*Attesting Officer*

*Commissioner of Patents and Trademarks*